United States Patent [19]

Aoyama

[11] 4,103,488

[45] Aug. 1, 1978

[54] INTERNAL COMBUSTION ENGINE WITH CONTROL SYSTEM FOR SECONDARY AIR SUPPLY

[75] Inventor: Syunichi Aoyama, Yokohama, Japan

[73] Assignee: Nissan Motor Company, Limited, Japan

[21] Appl. No.: 770,764

[22] Filed: Feb. 22, 1977

[30] Foreign Application Priority Data

Feb. 23, 1976 [JP] Japan ..... 51-17885

[51] Int. Cl.[2] ..... F01N 3/10; F02B 75/10

[52] U.S. Cl. ..... 60/289; 60/290; 60/293

[58] Field of Search ..... 60/289, 293, 290

[56] References Cited

U.S. PATENT DOCUMENTS

| | | | |
|---|---|---|---|
| 3,662,541 | 5/1972 | Sawada | 60/293 |
| 3,906,722 | 9/1975 | Garcea | 60/293 |

*Primary Examiner*—Douglas Hart

[57] ABSTRACT

An exhaust pressure responsive flow control valve is disposed in a secondary air supply passageway leading from the atmosphere to engine exhaust system. The valve has a valve member of a material which is movable by influence of magnetic fields and an electromagnet means for urging the valve member toward a valve closed position upon passing of electric current therethrough. First circuit means is provided which permits a relatively large current through the electromagnet when the exhaust gas temperatures are so high as to overheat the exhaust reactor or converter closing the valve to block secondary air supply through the passageway. Second circuit means is provided which permits a relatively small current through the electromagnet at normal stable operating conditions of the engine to restrict secondary air supply. At acceleration when a relatively large amount of secondary air is required no current is permitted through the electromagnet to open the valve.

9 Claims, 4 Drawing Figures

FIG. 1
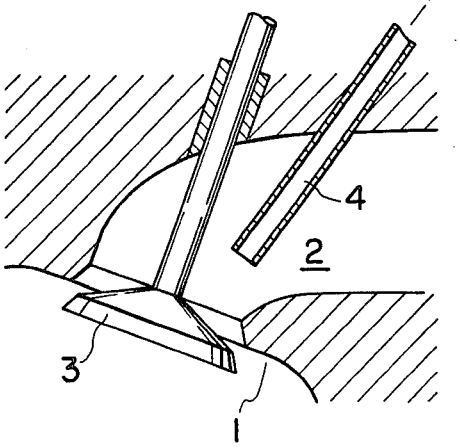
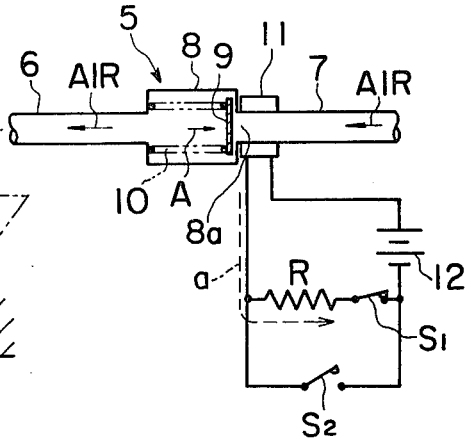
FIG. 2
FIG. 3
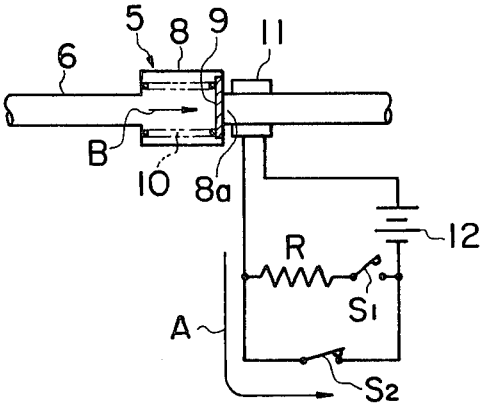
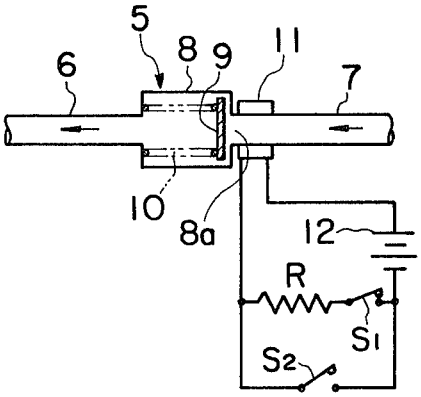
FIG. 4
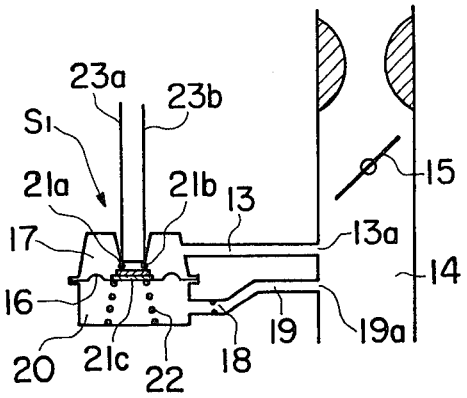

INTERNAL COMBUSTION ENGINE WITH CONTROL SYSTEM FOR SECONDARY AIR SUPPLY

BACKGROUND OF THE INVENTION

The present invention relates to internal combustion engines, and more particularly to control system for controlling amount of secondary air to be supplied to the exhaust system of such engines.

For the purpose of purifying the exhaust gases from the conventional internal combustion engines, it is conventionally proposed to promote oxidation of noxious components, such as CO and HC, of the exhaust gases by an exhaust purifier, such as a thermal reactor or a catalytic converter, with the help of secondary air supplied to the exhaust system.

In the arrangement as above, a valve means is provided in a passageway, through which the secondary air that is induced into the exhaust system with variation of exhaust pressure flows, for closing the passgeway when the exhaust pressure is relatively high, while opening the passageway when the exhaust pressure is relatively low. This arrangement has a drawback that there is high possibility of overheating and, in fatal cases, damaging the exhaust purifier since even when exhaust gas temperature rises at high speed high load engine operating conditions, the secondary air is kept supplied to the exhaust system.

SUMMARY OF THE INVENTION

It is therefore an object of the present invention to provide a control system for controlling amount of secondary air to be supplied to the engine exhaust system, the control system having a character that secondary air is prevented from being supplied to the exhaust system when exhaust gas temperature is high.

It is another object of the present invention to provide a control system of the character as above, which has a further character that a relatively great amount of secondary air is permitted to be supplied to the exhaust system at acceleration when CO and HC contents increase sharply, while a relatively small amount of secondary air is permitted to be supplied to the exhaust system at normal stable operating conditions as long as the exhaust gas temperature is not so high as to require prevention of secondary air supply.

DESCRIPTION OF THE DRAWINGS

The invention will be described further with reference to the accompanying drawings, in which:

FIG. 1 is a schematic representation of a preferred embodiment of a control system for secondary air supply according to the present invention;

FIGS. 2 and 3 show the same control system in various conditions; and

FIG. 4 is a schematic representation of a switch employed in the control system of FIG. 1.

DESCRIPTION OF THE INVENTION

An internal combustion engine shown in FIG. 1 comprises a combustion chamber 1, an exhaust port 2 and an exhaust valve 3 to open or close the exhaust port. The engine is provided with a secondary air supply nozzle 4 opening to the exhaust port 2 forming part of the engine exhaust system and at an area disposed in the vicinity of the exhaust valve 3.

A pressure responsive flow control valve 5 is provided which is closed to prevent secondary air from flowing through the nozzle 4 when the exhaust pressure is high, but opened to permit the secondary air to flow through the nozzle when the exhaust pressure is low. Thus the secondary air is supplied to the exhaust port 2 through the nozzle 4 in response to variation in exhaust pressure.

The valve 5 is fluidly disposed in a passageway connecting the nozzle 4 to the atmosphere through an air cleaner (not shown) or directly. The passageway includes a tube 6 connecting the nozzle 4 to the downstream side of the valve 5, with respect to the flow of air through the passageway, and another tube 7 connecting the upstream side of the valve to the atmosphere through the air cleaner or directly. The valve 5 has a valve casing 8 defining a chamber establishing communication between the tubes 6 and 7 and a valve seat 8*a* disposed about that end of the tube 7 which opens to the chamber of the valve casing 8. A valve member 9 adapted to seat on the valve seat 8*a* to close the tube 7 is movably disposed in the valve casing 8. The valve casing 8 accommodates therein a return spring 10 arranged between one side of the valve member 9 and the wall of the casing opposite to and spaced from the side of the valve member 9. The return spring 10 is selected such as to permit the valve member 9 to engage the valve seat 8*a* to close the tube 7 when the exhaust pressure transmitted to the tube 6 is high and to permit the valve member 9 to disengage from the valve seat 8*a*, against the bias action of the spring 10, to open the tube 7 when the exhaust pressure transmitted to the tube 6 is lower than the atmosphere pressure. The valve member 9 has an area on which force due to the exhaust pressure and tending to urge the valve member 9 towards the valve seat 8*a* is imposed. Therefore, air is supplied to the exhaust port 2 through the passageway and the nozzle 4 in response to variations in the exhaust pressure. The valve member 9 is made of a material which is movable by influence of magnetic fields. Suitable for the material is a ferromagnetic substance, such as mild steel, that exhibits extremely high magnetic permeability.

The return spring 10 as above may be eliminated if the valve 5 takes the form of a "reed valve".

An electromagnet 11 is arranged adjacent the valve seat 8*a* so as to attract the valve member 9 towards the valve seat 8*a* upon passing of electric current therethrough. Control means for energizing the electromagnet 11 comprises a source of electricity 12, a first circuit having a throttle switch $S_2$ and a second circuit having a resistor R and an acceleration switch $S_1$. The acceleration switch $S_1$ is a normally closed switch that is opened upon acceleration, that is; upon rapid opening of throttle valve by accelerator pedal, while the throttle switch $S_2$ is a normally open switch that is closed at high speeds under high loads. The first and second circuits are in parallel to each other with respect to the electromagnet 11 and the source of electricity 12 and they are connected in series with the electromagnet 11, as shown in FIG. 1.

At normal stable operating conditions when the normally closed acceleration switch $S_1$ is closed and the normally open throttle switch $S_2$ is opened (as shown in FIG. 1), a relatively small current *a* may be permitted to flow through the electromagnet 11 because of the load of the resistor R causing the electromagnet to attract the valve member 9 towards the valve seat 8*a* with a relatively little force A thus throttling the flow of secondary air past through the valve seat 8a as compared to the following case, the direction of flow of secondary air being indicated by arrows.

At acceleration when the switch $S_1$ is now opened and the switch $S_2$ remains opened (as shown in FIG. 2), no current may flow through the electromagnet 11 thus increasing the flow of secondary air past through the valve seat 8a to a degree needed to meet the required amount of secondary air for sufficient oxidation of the exhaust gases at accelerating operating condition of the engine.

At high speed high load operation conditions when the switch $S_2$ is now closed and the switch $S_1$ remains opened (as shown in FIG. 3), a relatively large current A may be permitted to flow through the electromagnet 11 causing the electromagnet to attract the valve member 10 towards the valve seat 8a with a relatively large force so as to urge the valve member into firm engagement with the valve seat 8a thus blocking the supply of secondary air. This, therefore, prevents overheating reactors or converters in exhaust systems.

Alternatively, the switch $S_2$ may be replaced with a normally open exhaust temperature switch which is closed when the exhaust system temperature, such as exhaust gas temperature or reactor temperature or catalytic converter temperature, is higher than a predetermined value.

Alternatively, such a temperature switch may be connected in parallel to the switch $S_2$.

One example of the normally closed acceleration switch $S_1$ is shown in FIG. 4. The switch shown in FIG. 4 comprises a flexible membrance 16, such as a diaphragm, forming on one side thereof a first air tight vacuum chamber 17 and on the opposite side thereof a second air tight vacuum chamber 20. The first vacuum chamber 17 is fluidly connected by a passage 13 to a vacuum port 13a opening to the carburetor induction passage 14 at a location downstream of a carburetor throttle valve 15, while the second vacuum chamber 20 is fluidly connected by a passage 19, which is provided with an orifice 18, to a second vacuum port 19a opening to the induction passage 14 at a location disposed downstream of the carburetor throttle valve 15. A pair of fixed electrical contacts 21a and 21b are arranged in the first vacuum chamber 17, while a movable electrical contact 21c cooperating with the fixed contacts is attached securely to the diaphragm 16. Denoted by 23a is a lead line connecting the contact 21a to the resistor R, while denoted by 23b is a lead line connecting the other contact 23b to the battery 12. Within the second vacuum chamber 20 a return spring 22 is arranged so as to prevent excessive flexture of the diaphragm towards the chamber 20.

The operation of the switch $S_1$ shown in FIG. 4 is as follows.

When vacuum level in the induction passage 14 is stable at normal stable operating conditions of the engine, vacuum in the chamber 17 is equal to that in the chamber 20 so that the movable contact 21c is urged to engage both of the contacts 21a and 21b by the return spring 22 thus rendering the switch $S_1$ closed.

At acceleration when the throttle valve 15 is opened rapidly to cause vacuum in the induction passage 14 to reduce and approaches to the atmospheric pressure, this change in vacuum is transmitted to the first chamber 17 with no delay, but the transmission of this change to the second chamber 20 is delayed due to the provision of the orifice 18. Under this condition, the vacuum in the chamber 20 is higher than that in the chamber 17 urging the diaphragm towards the chamber 17 against the action of the return spring 22 disengaging the contact 21c from both of the contacts 21a and 21b thus rendering the switch $S_1$ opened.

It will now be understood that according to the secondary air supply control system of the invention at normal stable operating conditions supply of secondary air is restricted appropriately, at acceleration the supply of the secondary air is relatively increased to effect efficient oxidation of the exhaust gases, and at high speeds under high loads the supply of the secondary air is blocked to preventing reactors or converters in the engine exhaust systems from being overheated.

What is claimed is:

1. An internal combustion engine comprising:

an exhaust system;

a passageway having at one end thereof a nozzle opening to said exhaust system, said passageway having an opposite end thereof communicating with the atmosphere;

a valve means responsive to exhaust pressure in said exhaust system for opening said passageway when said exhaust pressure is relatively low, but closing said passgeway when said exhaust pressure is relatively high, said valve means having a valve member of a material which is movable by influence of magnetic fields and an electromagnet means for attracting said valve member towards a valve seat upon passing of electric current therethrough;

first circuit means for permitting a predetermined relatively large electric current to pass through said electromagnet at a first predetermined operating condition of the engine, causing said electromagnet to urge said valve member towards said valve seat to close said passageway; and second circuit means for permitting a predetermined relatively small electric current to pass through said electromagnet at a second predetermined operating condition of the engine, causing said electromagnet to urge said valve member towards said valve seat to restrict said passageway, but preventing electric current from passing through said electromagnet at a third predetermined operating condition of the engine.

2. An internal combustion engine as claimed in claim 1, in which said first predetermined operating condition of the engine is a high speed high load operating condition, said second predetermined operating condition of the engine is a normal stable operating condition, and said third predetermined operating condition of the engine is an acceleration operating condition.

3. An internal combustion engine as claimed in claim 1, in which said first predetermined operating condition of the engine is an operating condition with high exhaust gas temperature, said second predetermined operating condition of the engine is a normal stable operating condition, and said third predetermined operating condition of the engine is an acceleration operating condition.

4. An internal combustion engine as claimed in claim 1, in which said first predetermined operating condition of the engine is one of high speed high load operating condition and an operating condition with high exhaust gas temperature, said second predetermined operating condition of the engine is a normal stable operating condition, and said third predetermined operating condition of the engine is an acceleration operating condition.

5. An internal combustion engine as claimed in claim 1, in which said first circuit means includes normally open switch means connected in series with the electromagnet, said normally open switch means being operative to be closed at said first predetermined operating condition of the engine.

6. An internal combustion engine as claimed in claim 5, in which said normally open switch means is responsive to exhaust gas temperature and to a carburetor throttle condition.

7. An internal combustion engine as claimed in claim 5, in which said normally open switch means is responsive to one of exhaust gas temperature and carburetor throttle condition.

8. An internal combustion engine as claimed in claim 5, in which said second circuit means includes normally closed switch means and a resistor connected in series with said normally closed switch means, said normally closed switch means being operative to be opened in response to that change in manifold vacuum which exhibits accelerating condition of the engine, said series connected normally closed switch means and said resistor being connected to said electromagnet in parallel to said normally open switch means.

9. An internal combustion engine as claimed in claim 8, in which said normally closed switch means comprises:

flexible membrane means forming one side thereof a first air tight chamber and on the opposite side thereof a second air tight chamber;

first passage means for connecting said first chamber to a vacuum port opening to the carburetor induction passage at a location downstream of the carburetor throttle valve;

second passage means for connecting said second chamber to a second vacuum port opening to the carburetor induction passage at a location downstream of the carburetor throttle valve, said second passage means having flow restricting means therein;

a pair of fixed electrical contacts arranged in said first chamber; and a movable electrical contact cooperating with said pair of electrical contacts, said movable electrical contact being movable by said flexible membrane means.

* * * * *